United States Patent [19]

Dahl et al.

[11] Patent Number: 4,555,701

[45] Date of Patent: Nov. 26, 1985

[54] LEGIBILITY ENHANCEMENT FOR ALPHANUMERIC DISPLAYS

[75] Inventors: Richard E. Dahl, Rochester; Daniel P. Faflak, Mazeppa; Lee A. Sendelbach, Rochester, all of Minn.

[73] Assignee: International Business Machines Corporation, Armonk, N.Y.

[21] Appl. No.: 453,404

[22] Filed: Dec. 27, 1982

[51] Int. Cl.[4] ..... G09G 1/08

[52] U.S. Cl. ..... 340/736; 340/728

[58] Field of Search ..... 340/736, 728, 709

[56] References Cited

U.S. PATENT DOCUMENTS 4,028,695 6/1977 Saich ..... 340/709 X 4,298,867 11/1981 Craig ..... 340/728

*Primary Examiner*—Gerald L. Brigance

*Assistant Examiner*—Vincent P. Kovalick

*Attorney, Agent, or Firm*—J. Michael Anglin

[57] ABSTRACT

Alphanumeric CRT display has normal/reverse video attribute. In reverse video, the character dots are made wider than in normal video, to equalize the apparent width of the dots in the two modes.

8 Claims, 4 Drawing Figures

LEGIBILITY ENHANCEMENT FOR ALPHANUMERIC DISPLAYS

BACKGROUND

The present invention relates to data displays, and more specifically concerns apparatus and method for equalizing the appearance of characters having different attributes or display modes.

Many present data-processing displays allow alphanumeric character images to be presented with different "display attributes", such as highlighting, blinking, and normal/reverse mode. In this last mode, the images can be selectively displayed as either bright characters on a dark background (normal video) or as dark characters on a bright background (reverse video).

A problem which occurs especially in raster-scanned cathode-ray-tube (CRT) displays is that the vertical character strokes appear significantly narrower in the reverse mode than they do in the normal mode. This asymmetry is coupled with the fact that the horizontal strokes are not narrowed, which further unbalances the reversed character images. In an age when many people spend hours at a video display, the human factors of the character images become very important; seeming design details may make the difference between job satisfaction and constant discomfort or even physical illness.

SUMMARY OF THE INVENTION

The present invention improves the human-factors aspects of alphanumeric displays by automatically equalizing the appearance of characters having different attributes. It is especially useful in CRT displays having normal/reverse mode and similar attributes. The cost of its implementation is very low, easily affordable in even the smallest terminals.

Broadly speaking, the invention equalizes the apparent width of the individual dots comprising a character image by producing different actual dot widths or durations, depending upon the state of an attribute control signal.

DRAWING

DETAILED DESCRIPTION

Figure 1:
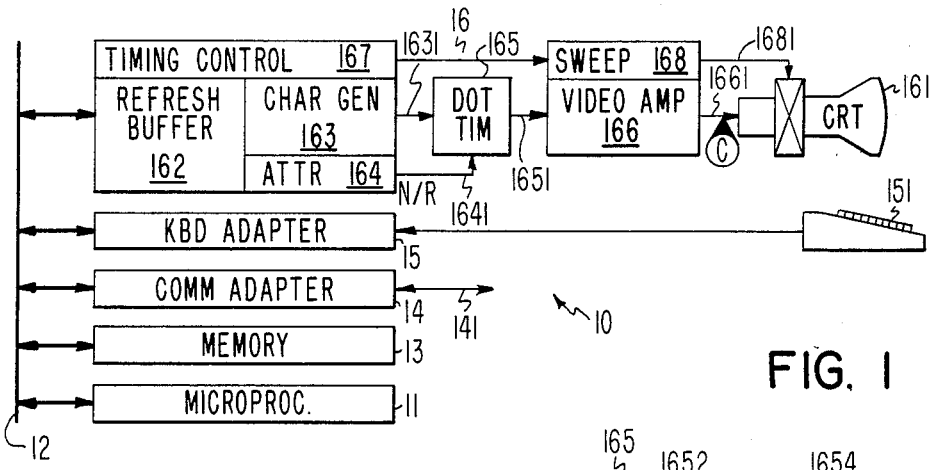
FIG. 1 is a block diagram of a display terminal incorporating the present invention.

FIG. 1 is a high-level block diagram illustrating a type of alphanumeric display terminal 10 in which the present invention may find utility. Microprocessor 11 controls the remaining units via conventional address-/data/control bus 12. Memory 13 contains read-only (ROM) memory for holding various conventional operating programs and read/write (RAM) memory for data. Communications adapter 14 manages a data-transmission protocol with a data processor or other device over line 141. Keyboard adapter 15 interfaces a standard alphanumeric keyboard 151.

Display adapter 16 includes conventional units for presenting a screen of characters to a raster-scanned cathode-ray-tube (CRT) display 161. Refresh buffer memory 162 sends character codes sequentially to character generator 163, which converts them to series of timed raw digital signals having ON and OFF levels on a single video line 1631. Attribute decoder 164 converts further data in buffer 162 into signals representing specific display attributes, such as highlighting, blinking, and normal/reverse (N/R) video modes. "Normal" mode presents the characters as bright or phosphor active dots (white, green, amber, etc.) on a dark background. "Reverse" mode has dark or phosphor inactive dots (black, etc.) characters on a bright background. The bivalent N/R mode signal appears on line 1641. Dot-timing circuit 165 alters the duration of the individual raw video pulses or dots according to the state of the N/R mode signal to produce a modified digital video signal 1651 for video amplifier 166. Timing control 167 establishes signals for generating raster scan lines on CRT 161 via sweep circuits 168. All of the units of display adapter 16 are conventional, except for dot timer 165.

Figure 2:
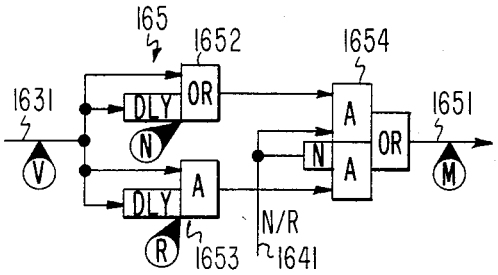
FIG. 2 is a logic diagram of a dot-timing circuit according to the invention.

FIG. 2 shows the details of dot-timing circuit 165. A first timing circuit 1652 lengthens the duration of positive (high-level) dots by inputting video line 1631 to an OR gate both directly and through a short delay line. A second timing circuit 1653 lengthens the duration of negative (low-level) dot pulses by inputting line 1631 to an AND gate both directly and through another delay line. Multiplexer 4 selects either the output of the first dot timer 2 or the second dot timer 1653 as the modified video signal 1651. When a high level on N/R mode signal 1641 indicates normal mode, the upper AND gate forwards the output of timer 1652 through the OR gate to line 1651; when a low level indicates reverse mode, a NOT gate causes the lower AND to send the output of timer 1653 through the OR gate instead. Although two explicit timers are used here to obtain the two different dot durations for reasons described below, the original dot duration on input line 1631 might be usable directly as one of the durations sent to output line 1651.

Figure 3:
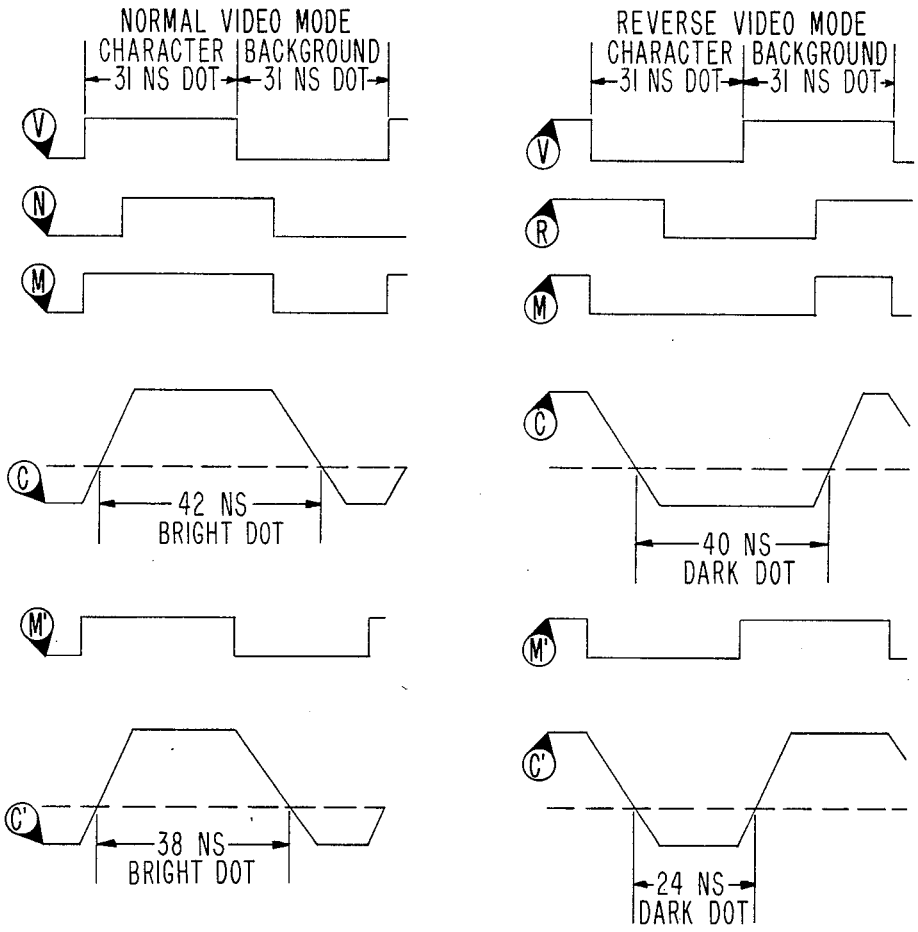
FIG. 3 shows waveforms associated with the invention.

FIG. 3 shows exemplary wave forms and compares them with the prior art. Waveform V shows a 31 nanosecond (nsec) positive pulse on line 1631 representing a bright dot in a normal-mode character and a 31 nsec negative pulse representing a dark dot in a reverse-mode character to be displayed. Waveform N is the positive pulse delayed by 6 nsec in the first timing circuit 1652, FIG. 2, while R shows the negative pulse delayed by 15 nsec in the second timing circuit 1653. Waveform M shows the modified video signal on line 1651 for both a positive normal-mode dot pulse and a negative reverse-mode dot pulse. Since the OR in circuit 1652 is active as long as either input is high, the pulse is lengthened to 37 nsec. Since the AND in circuit 1653 is active only when both inputs are high, the reverse pulse is lengthened to 46 nsec. That is, the negative pulse in the logic signal M for a dot in the reverse video mode is about 25% longer than the positive pulse for a dot in the normal mode. Waveform C represents an idealized exponential voltage at the cathode of CRT 161. Note that the rise and fall times differ from each other because of, e.g., charge-storage effects in the amplifier output transistors. The dashed line shows the voltage threshold above which a dot becomes visible on the fact of the CRT. The differing lengths of the positive and negative pulses are chosen by simple experiment for a particular video amplifier and CRT to equalize the actual dot lengths seen on the CRT.

In FIG. 3, the lengthening of N and R result in the same perceived size for both the bright dots in the normal video mode and the dark dots in the reverse mode. Although the perceived dot length is a complicated function of the duration and shape of wave C, it can be roughly approximated by the time spent above the threshold in wave C for a bright dot and the time below the threshold for the reverse mode. In the present example, these times are 42 nsec and 40 nsec.

Another effect is also significant. In conventional displays, single-dot-wide vertical character strokes appear significantly thinner than multi-dot horizontal strokes. To compensate for this effect, the dots are lengthened in the normal mode as well as in the reverse mode. The normal-mode duration is chosen to equalize the apparent widths or thicknesses of the horizontal and vertical character strokes in the normal mode. The reverse-mode duration is chosen similarly for the reverse mode. Their ratio determines the equality between the appearance of characters in the two modes. These goals overspecify the delay parameters; however, a good compromise is easily obtainable with routine experimentation for any particular display.

Waves V and C' illustrate the improvement obtained by the invention. Again, wave V has equal-duration positive and negative dot pulses, both having a 31-nsec duration. The duration of the normal-mode dot in C' is about 38 nsec, and the reverse-mode dot shrinks to 24 nsec, only $\frac{2}{3}$ of the normal dot.

Figure 4:
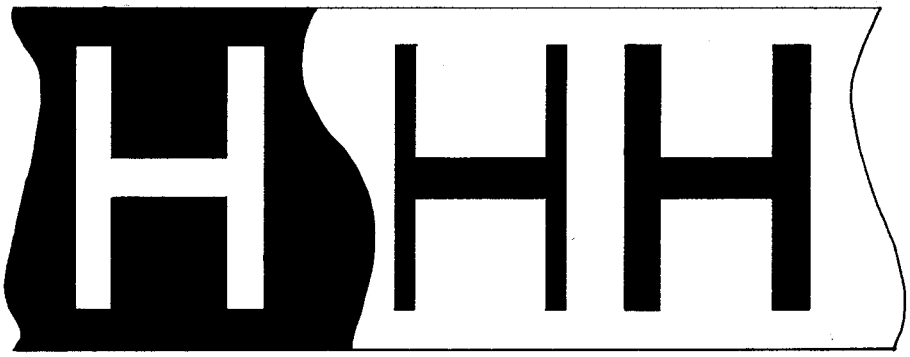
FIG. 4 illustrates the appearance of characters associated with the invention and with the prior art.

FIG. 4 demonstrates the appearance of one character in normal mode, and the same character in reverse-video mode, both with and without the equalization provided by the invention. The leftmost character "H" is in normal mode, a bright character on a dark background. The other two characters are in reverse-video mode, dark characters on a bright background. The middle "H" has narrow vertical strokes caused by the on-equalized dot durations of the prior art. The horizontal strokes have the width of a full raster scan, and appear both wider and brighter than the vertical strokes. The rightmost "H" has equalized dot durations according to the invention, and thus appears to be a true inverse of the normal-mode character at the far left.

Video amplifier 166, FIG. 1, is the major cause of asymmetry especially when it operates near its bandwidth limit. However, other factors may also obtrude. For example, the CRT phosphor may have different thresholds for rise and fall of luminosity. Also, the psychologically perceived width of a bright line on a dark background is greater than that of an otherwise identical dark bar on a bright background; this effect is heightened when the background is self-luminous (as in a CRT), rather than merely more reflective of incident light (such as paper). The overall object is to equalize the dot width as perceived by the viewer. Circuit 165, FIG. 2, allows this to be done by varying the normal and reverse dot durations, regardless of the actual cause of the problem.

Only the single mode-control line 1641, FIG. 2, is shown as affecting the dot durations. If, for example, variations in real or perceived width between the two modes were found to occur with different brightness levels, screen positions of the characters, and so forth, additional controls could easily be added to compensate for them as well. Differences in dot times could also be achieved by means other than switching between fixed delay lines, or by instrumentalities other than delay lines. The difference between normal and reverse durations could be quantized into a number of increments. Moreover, the concept of the invention can be applied to display modes or attributes other than a simple normal/reverse. For example, highlighted (intensified) modes may alter perceived or actual dot widths, and color displays may exhibit differences between dot widths of characters in different colors. In the latter case, multiple video outputs (e.g., red, green, blue) are utilized, as well as multiple control signals. The same principles could also be applied to other forms of character images, such as dot-matrix printing and thermal or erosion printing.

We claim as our invention:

1. In a display for alphanumeric character images made up of a matrix of individual dots having a character-generator means for producing a raw video signal having first and second levels, and having attribute means for producing an attribute signal specifying a normal mode in which said first level represents said image dots and specifying a reverse mode in which said second level represents said image dots, said images being substantially the same overall size in both said modes, the improvement comprising:

timing means responsive to said raw video signal for producing a modified video signal having first and second dot durations different from each other; and switching means responsive to said attribute signal for selectively enabling said timing means to produce dots of said first and second durations for said normal mode and for said reverse mode respectively.

2. A display according to claim 1, further comprising a display means responsive to said video signal for producing bright dots for said first level and dark dots for said second level.

3. A display according to claim 2, wherein said display means is a cathode-ray tube.

4. A display according to claim 3, wherein said timing means produces said first and second dot durations so as to substantially equalize the perceived lengths of said bright dots and said dark dots on said cathode-ray tube in each of said modes.

5. A display according to claim 2, wherein said timing means comprises first and second timing circuits for producing said first and second durations respectively, said durations being longer than said first and second levels respectively of said raw video signal.

6. A method for enhancing the legibility of character images on a display means, comprising the steps of:

generating each said image as a sequence of dots in a video wave having plural lengths;

decoding an attibute signal having a normal mode and a reverse mode specifying which of said levels represent said image and which of said levels represent a background of said image;

imparting different first and second durations to those dots having levels representing said image, in response to whether said normal mode or said reverse mode has been decoded.

7. A method according to claim 6, wherein said timing means produces said first and second dot durations so as to substantially equalize the apparent size of said bright dots in said normal mode and said dark dots in said reverse mode.

8. A method according to claim 7, wherein said timing means further produces said first and second dot durations so as to substantially equalize the apparent size of vertical and horizontal strokes in said image.

* * * * *